United States Patent [19]

Yamakita

[11] Patent Number: 4,944,166

[45] Date of Patent: Jul. 31, 1990

[54] DYEING APPARATUS

[75] Inventor: Yoshimichi Yamakita, Uozu, Japan

[73] Assignee: Yoshida Kogyo K. K., Tokyo, Japan

[21] Appl. No.: 391,963

[22] Filed: Aug. 10, 1989

[30] Foreign Application Priority Data

Aug. 15, 1988 [JP] Japan ..... 63-202840

[51] Int. Cl.[5] ..... D06B 3/04

[52] U.S. Cl. ..... 68/157; 68/189; 68/198; 68/199

[58] Field of Search ..... 68/27, 5 D, 157, 158, 68/165, 162, 199, 188, 179, 178, 189, 198

[56] References Cited

U.S. PATENT DOCUMENTS

| | | | |
|---|---|---|---|
| 1,284,949 | 11/1918 | Kolk et al. | 68/157 |
| 1,600,973 | 9/1926 | Brewin et al. | 68/27 |
| 2,792,702 | 5/1957 | Newcomb et al. | 68/189 |
| 3,507,131 | 4/1970 | Stanway . | |
| 3,510,251 | 5/1970 | Fujii et al. | 68/178 |
| 3,596,481 | 8/1971 | Wilcox | 68/198 X |
| 3,635,053 | 1/1972 | Daniel . | |
| 3,659,441 | 5/1972 | Schulerer . | |
| 3,857,769 | 4/1975 | Inoue | 68/27 X |
| 4,689,972 | 9/1987 | Stanley | 68/5 D |
| 4,885,814 | 12/1989 | Eltz et al. | 68/177 X |

FOREIGN PATENT DOCUMENTS

| | | | |
|---|---|---|---|
| 692249 | 5/1940 | Fed. Rep. of Germany | 68/157 |
| 441425 | 1/1936 | United Kingdom | 68/189 |
| 2072724 | 10/1981 | United Kingdom . | |

*Primary Examiner*—Frankie L. Stinson

*Attorney, Agent, or Firm*—Hill, Van Santen, Steadman & Simpson

[57] ABSTRACT

A dyeing apparatus is disclosed for dyeing different forms of textile material with different colors, the apparatus comprising a non-perforated cylindrical beam having a plurality of partitions defining therebetween dye chambers each containing a different color dye liquor and a plurality of winding frames extending between the partitions axially of the beam and connected rotatably with a rotary shaft driven by a motor. Adjacent chambers are isolated from one another and each hermetically sealed except at an upper portion to which a gate member is pivotally connected. The beam is held stationary while the winding frames are in rotation with the rotary shaft.

4 Claims, 3 Drawing Sheets

DYEING APPARATUS

BACKGROUND OF THE INVENTION

1. Field of the Invention

This invention relates to an apparatus for dyeing fabrics in the form of cloth, tapes, yarns and other elongate materials and has particular reference to such a dyeing apparatus which is capable of dyeing different kinds of fabric materials with different colors simultaneously in a continuous cycle of operation.

2. Prior Art

Modern dyeing apparatus known in the art are designed to operate at elevated temperature and pressure for dyeing textile or fabric materials with a single hue of color at a time and are capable of also washing or otherwise treating the materials in a single set of equipment. However, in the case where a variety of fabric materials need be dyed in limited small lots, it would become necessary to provide so many apparatuses of appropriate size as well as so much work force and expenses to cope with the need. This problem would lead to downtime of existing large apparatus for large lot production, resulting in inefficient and uneconomical management of the whole plant.

SUMMARY OF THE INVENTION

With the foregoing problems of the prior art in view, the present invention seeks to provide a novel dyeing apparatus which incorporates such structural features which will enable versatile forms of fabric to be dyed in different colors simultaneously with use of a single dye beam.

According to the invention, a dyeing apparatus comprises a horizontally mounted pressure vessel, a nonperforated cylindrical beam concentrically mounted therein, a plurality of partitions in the beam defining a plurality of dye chambers isolated from one another for dyeing therein a fabric material each with a different color, a rotary shaft extending through the partitions axially of the beam, and a plurality of winding frames rotatably connected to the rotary shaft and adapted to wind thereon the fabric material, the beam being held stationary while the winding frames are in rotation with the rotary shaft.

The above and other features of the invention will be better understood from the following detailed description taken in conjunction with the accompanying drawings.

DETAILED DESCRIPTION

Figure 1:
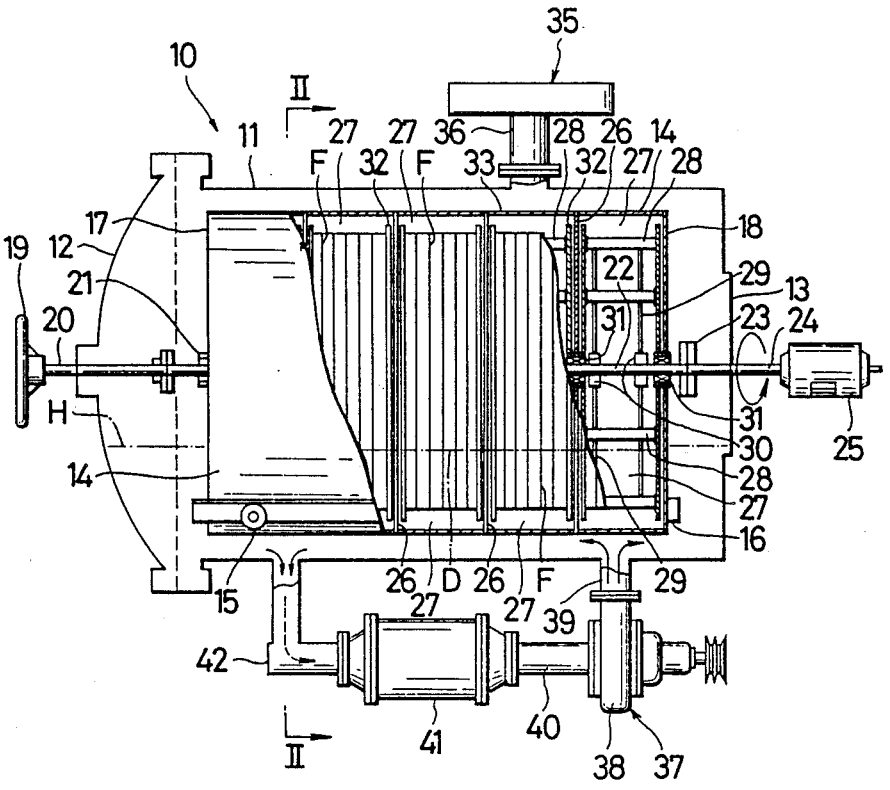
FIG. 1 is a side elevational, partly sectional, view of a dyeing apparatus embodying the invention.

Referring now to the drawing and FIG. 1 in particular, there is shown a dyeing apparatus 10 constructed in accordance with a preferred embodiment of the invention for dyeing woven or knitted fabric F in the form of cloth, tapes, yarns and other elongate textile materials. The apparatus 10 comprises a horizontally mounted cylindrical vessel 11 provided at one or front end with an outwardly dished openable end cover 12 and at the opposite or rear end with a vertical closed end wall 13.

Figure 2:
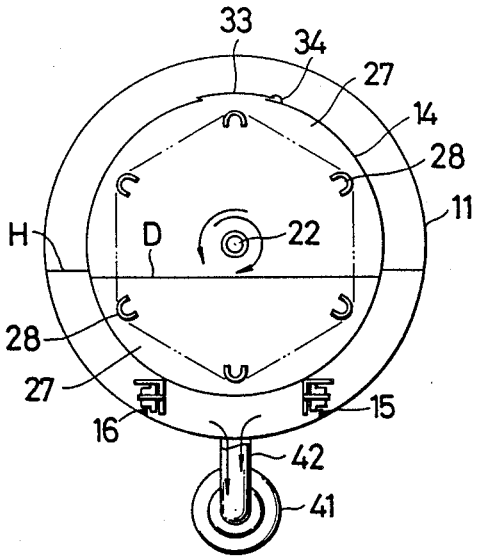
FIG. 2 is a diagrammatic cross-sectional view taken on the line II—II of FIG. 1.

Designated at 14 is a cylindrical non-perforated beam concentrically mounted within the vessel 11 and nonrotatively supported on a pair of parallel rails 15 and 16 (FIG. 2). Front and rear ends of the beam 14 are closed by disc-like end walls 17 and 18, respectively.

A wheel handle 19 has its shaft 20 extending horizontally through the dished cover 12 and releasably engageable with a socket member 21 secured centrally to the front end wall 17. The handle 19 is used to manipulate the mounting and dismounting of the beam 14 which is horizontally movable on and along the rails 15, 16 into and out of the vessel 11 through the openable front end cover 12.

A rotary shaft 22 concentrically extends through the beam 14 and is rotatably received at one end in a bearing (not shown) at the front end wall 17 and connected via coupling flange 23 releasably to a drive shaft 24 of a motor 25.

The beam 14 is provided with a plurality of disc partitions 26 parallel and coextensive with the front and rear end walls 17 and 18 and defining therebetween dye chambers 27 each of which accommodates each different or similar fabric material F to be dyed with each different or similar color as the case may be. Each chamber 27 is thus isolated from adjacent chambers 27 and provided therein with a plurality of winding frame members 28 extending radially equidistantly around the rotary shaft 22 by connecting bars 29 which extend via couplings 30 radially from the shaft 22. The winding frames 28 in each chamber 27 are equally spaced to define a cross-sectionally imaginary hexagon as shown in FIG. 2 and adapted to wind thereon a fabric strip which is presently illustrated to be a slide fastener tape.

The partitions 26 are integral with the beam 14 which is held stationary during the dyeing operation while the winding frames 28 are in rotation with the rotary shaft 22. The partitions 26 are isolated from the rotary shaft 22 extending axially therethrough rotatably in bearings 31 to which the partitions 26 are sealingly connected. Also sealingly connected to the bearings 31 are spacers 32 disposed in spaced, confronting relation to the partitions 26 and adapted to keep the fabric F away from the partitions 26.

Designated at 33 is a gate member extending over each of the chamber 27 and pivotally connected via hinge 34 between adjacent partitions 26 so as to expose and conceal the wound fabric material F in each chamber 27.

A pressure fluid reserve tank 35 supported externally on the vessel 11 above the gate member 33 of the beam 14 is in flow communication via conduit 36 with the vessel 11 for supplying compressed air or other pressure fluid to the interior of the vessel 11.

Designated at 37 is a heat medium supply mounted externally below the vessel 11 and including a recycle pump 38 feeding a suitable heating medium such as steam through conduit 39 to the vessel 11. The heat medium supply 37 is connected via conduit 40 to a heat exchanger 41 which is in turn connected via conduit 40 in flow communication with the vessel 11.

In normal operation of the apparatus 10, a dye liquor is supplied to a liquid level D while a heating medium to a level H as shown in FIG. 2. The gate member 33 may be held open as shown in FIG. 3 so as to receive increased amounts of the pressure fluid into the dye chambers 27, or may alternatively be closed to receive controlled amounts of the fluid as the gate 33 cracks open at its free end opposite to the hinge 34.

Figure 3:
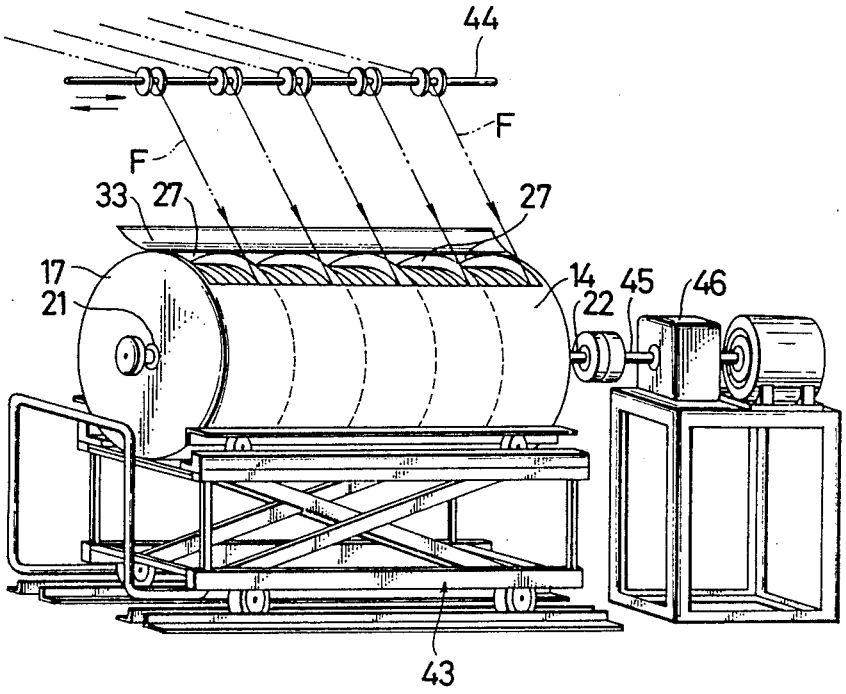
FIG. 3 is a perspective view of a dye beam shown wound with an elongate fabric tape.

FIG. 3 shows the beam 14 as having been removed from the vessel 11 and mounted on a cradle 43 for receiving a fresh batch of fabric tape F via traverse guide 44 from a supply source not shown. Upon filling a dye liquor to a predetermined level in each chamber 27 in the beam 14, the fabric F in each of the individual rows is wound on the respective winding frame 28 in the respective dye chamber 27, the winding frame 28 being rotated with the rotary shaft 22 which is, in the mode of winding (FIG. 3), connected to a drive shaft 45 of a motor 46. The beam 14 loaded with the fresh fabric material F is transported on the cradle 43 and mounted in place on the rails 15, 16 within the vessel 11. The dyeing operation commences by coupling the rotary shaft 22 with the drive shaft 24 of the motor 25.

Obviously, various modifications and variations of the present invention are possible in the light of the above teaching. It is therefore to be understood that within the scope of the appended claims the invention may be practiced otherwise than as specifically described.

What is claimed is:

1. A dyeing apparatus for dyeing fabric materials with different colors which comprises:

(a) a horizontally mounted cylindrical vessel having a dished cover at one end and a rear end wall at the opposite end;

(b) a non-perforated cylindrical beam having both ends closed by end walls and concentrically mounted within said vessel and non-rotatively supported on rails, said beam having a plurality of partitions extending parallel and coextensive with said end walls and defining therebetween a plurality of dye chambers;

(c) a rotary shaft extending rotatably in bearings axially through said partitions;

(d) a plurality of winding frame members extending parallel with said rotary shaft and connected rotatably therewith by radially extending connecting bars;

(e) a drive motor having a drive shaft releasably connected to said rotary shaft;

(f) a pressure fluid reserve tank externally supported on and communicating with said vessel; and (g) a heat medium supply externally mounted on and communicating with said vessel.

2. A dyeing apparatus according to claim 1 further including a gate member pivotally connected between adjacent partitions to expose and conceal the fabric F in each chamber and located below said tank.

3. A dyeing apparatus according to claim 1 further including spacers confronting in spaced relation to said partitions to keep the fabric F away therefrom.

4. A dyeing apparatus according to claim 1 wherein said beam is held stationary while said winding frame members are in rotation with said rotary shaft.

* * * * *